US005960646A

United States Patent [19]

Schmid et al.

[11] Patent Number: 5,960,646

[45] Date of Patent: Oct. 5, 1999

[54] FABRIC TAKE-OFF ROLLER FOR FLAT BED KNITTING MACHINES

[75] Inventors: Franz Schmid, Bodelshausen; Armin Diebold, Burladingen, both of Germany

[73] Assignee: H. Stoll GmbH & Co., Reutlingen, Germany

[21] Appl. No.: 09/144,180

[22] Filed: Aug. 31, 1998

[30] Foreign Application Priority Data

Aug. 30, 1997 [DE] Germany ..... 197 38 013

[51] Int. Cl.[6] ..... D04B 15/90

[52] U.S. Cl. ..... 66/149 R; 226/194; 492/40

[58] Field of Search ..... 66/147, 148, 149 R, 66/150; 139/304, 309; 87/31; 242/541, 540, 541.4; 492/15, 60, 40, 41; 226/181, 190, 194

[56] References Cited

U.S. PATENT DOCUMENTS

| | | | |
|---|---|---|---|
| 1,052,403 | 2/1913 | Becker | 482/40 |
| 4,478,058 | 10/1984 | Kazmaier et al. | 66/149 R |
| 4,592,214 | 6/1986 | Goller et al. | 66/149 R |
| 4,777,808 | 10/1988 | Kuhnert | 66/149 R |
| 4,790,152 | 12/1988 | Geitner | 66/149 R |
| 5,425,251 | 6/1995 | Schmid et al. | 66/149 R |

FOREIGN PATENT DOCUMENTS

| | | | |
|---|---|---|---|
| 261049 | 3/1988 | European Pat. Off. | 66/149 R |
| 3644932 | 6/1988 | Germany | 66/149 R |
| 3735996 | 4/1989 | Germany | 66/149 R |

*Primary Examiner*—John J. Calvert
*Assistant Examiner*—Larry D. Worrell, Jr.
*Attorney, Agent, or Firm*—Jones, Tullar & Cooper, P.C.

[57] ABSTRACT

A fabric take-off roller arrangement for flat bed knitting machines is provided with two driven and parallel arranged fabric take-off rollers, between which a fabric web is tangentially guided, wherein at least one of the fabric take-off rollers is made up of roller elements, which are arranged next to each other in the axial direction and are coupled, fixed against relative rotation. The rollers are rotatably maintained on one bearing support, which is pivotable in a direction vertically to the orientation of the roller elements, and which are hingedly seated in relation to each other as well as to the bearing support and are pressed against the other fabric take-off roller in an individually adjustable manner. In order to create an improved hinged torque transmission connection, which can be produced more cost-effectively and is simpler to mount, between adjoining roller elements of the respective fabric take-off roller of such a fabric take-off arrangement, it is provided that on their facing ends, which are provided with a gear ring, the roller elements are coupled, fixed against relative rotation, with a gear wheel arrangement rotatably maintained in the bearing support, wherein the seating of axially adjoining roller elements, which are axially hinged in relation to each other, so in that the teeth of the gear wheel arrangement and/or of the gear ring of the roller elements are arcuate transversely with respect to the circumference and crowned in longitudinal section.

15 Claims, 5 Drawing Sheets

FABRIC TAKE-OFF ROLLER FOR FLAT BED KNITTING MACHINES

TECHNICAL FIELD

The present invention relates to a fabric take-off roller arrangement particular for flat bed knitting machines with two fabrics take-off rollers, which preferably are both driven and arranged parallel and between which a fabric web is tangentially guided. One of the fabric take-off rollers includes roller elements which are arranged next to each other in the axial direction of the roller, and are coupled to be fixed against relative rotation. The rollers are maintained on one bearing support which is pivotable in a direction vertically to the orientation of the roller elements. The rollers are hingedly seated with respect to each other as well as to the bearing support, are pressed against the other fabric take-off roller in an individually adjustable manner.

BACKGROUND OF THE INVENTION

In connection with such a fabric take-off roller arrangement, in particular for flat bed knitting machines, known from DE 42 42 969 A1, the roller elements are provided on their facing sides with claws, which mesh with as well as grip next to each other, of which the claws of the one end are two-dimensionally crowned on their surfaces which are adjacent to the claws of the other end. In this way adjacent roller elements are seated hingedly against each other, so that the ends of adjacent roller elements can be moved in a direction perpendicularly to the longitudinal extension of the fabric take-off roller by means of the bearing support.

It has been shown that the claws used for transmitting a torque, which are provided with crowned surfaces, can only be produced with a large technical outlay, and therefore exceed the cost allowance for such a roller element. In addition, the assembly of a fabric take-off roller from the several roller elements, which must be aligned axially, is relatively difficult, since the claws of respectively adjacent roller elements must be put together inside a radial ball bearing maintained on the bearing support.

SUMMARY OF THE INVENTION

It is therefore an object of the present invention to provide a fabric take-off roller arrangement, in particular for flat bed knitting machines, of the type mentioned at the outset, between adjoining roller elements of the respective fabric take-off roller, which provides an improved hinged torque transmission connection, which can be produced more cost-effectively and is simpler to mount.

To attain this object, rollers are provided for a fabric take-off roller arrangement, in particular for flat bed knitting machines, of the type mentioned at the outset having facing ends which are provided with a gear ring, the roller elements are coupled, fixed against relative rotation, with a gear wheel arrangement rotatably maintained in the bearing support, wherein the seating of axially adjoining roller elements, which are axially hinged in relation to each other, is such that the gear teeth of the gear wheel arrangement and/or the gear ring of the roller elements are arcuate transversely with respect to the circumference and crowed in longitudinal section.

A considerable simplification in the production of the hinged torque transmission means between two adjoining roller elements has been achieved by means of the present invention, since both the gear ring of the gear wheel arrangement and that of the roller elements can be produced in a simpler way. Furthermore, the assembly of the individual roller elements lined up next to each other is simplified in that respectively only the gear rings of the roller element and the gear wheel arrangement need to be plugged into each other in the axial direction.

An advantageous arrangement results from thefact that the gear wheel arrangement has two axially adjoining gear wheels of equal diameter, which receive the bearing support between themselves, in accordance with which each bearing support can be equipped with the gear wheel arrangement in a simple manner.

Production techniques are simplified in that the two gear wheels are equipped with teeth that are identical and which are arcuate and embodied to be crowned in longitudinal section, so that for example, the gear wheels can be made of a suitable plastic material by injection molding processes.

By means of providing the gears with form closure profiles fitting into each other, a connecting device between the gear wheels has been achieved, which is easy to assemble and transmits the respective torque.

It is possible to realize a solid connection, which can withstand the working conditions, between the two gear wheels of a gear wheel arrangement in that the two gear teeth are braced against each other in the axial direction. In the process it is useful at the same time, to clamp the inner ring of the rolling bearing between the two gear wheels and to fix the outer ring against relative rotation with the bearing support, thereby connecting the two gear wheels with the one section of the radial rolling bearing in a manner fixed against relative rotation.

Assembly is further simplified in a particularly advantageous manner in that the shaft is provided with fixing elements for the bearing supports located at predetermined axial distances. By this it is possible in accordance with each arrangement of a roller element to push on the bearing supports provided with the gear wheel arrangement and to fix them in place in the predetermined position, wherein the one side of the gear wheel arrangement is in engagement with the adjoining roller element.

By constructing the bearing supports to be flat plane, plate-like elements which penetrate the entire gap between two adjoining roller elements it is achieved that the gap between adjoining roller elements is filled to a considerable extent in order to prevent loose knitting threads from being caught. The provision of a transversely extending cover strip also serve this purpose.

Further advantageous embodiments ensue from the characteristics of one or several of claims 12 to 14.

BRIEF DESCRIPTION OF THE DRAWINGS

Further details of the present invention can be taken from the following description, in which the invention is described in more detail and explained by means of the exemplary embodiment represented in the drawings. Shown are.

DETAILED DESCRIPTION OF PREFERRED EMBODIMENTS

Figure 1:
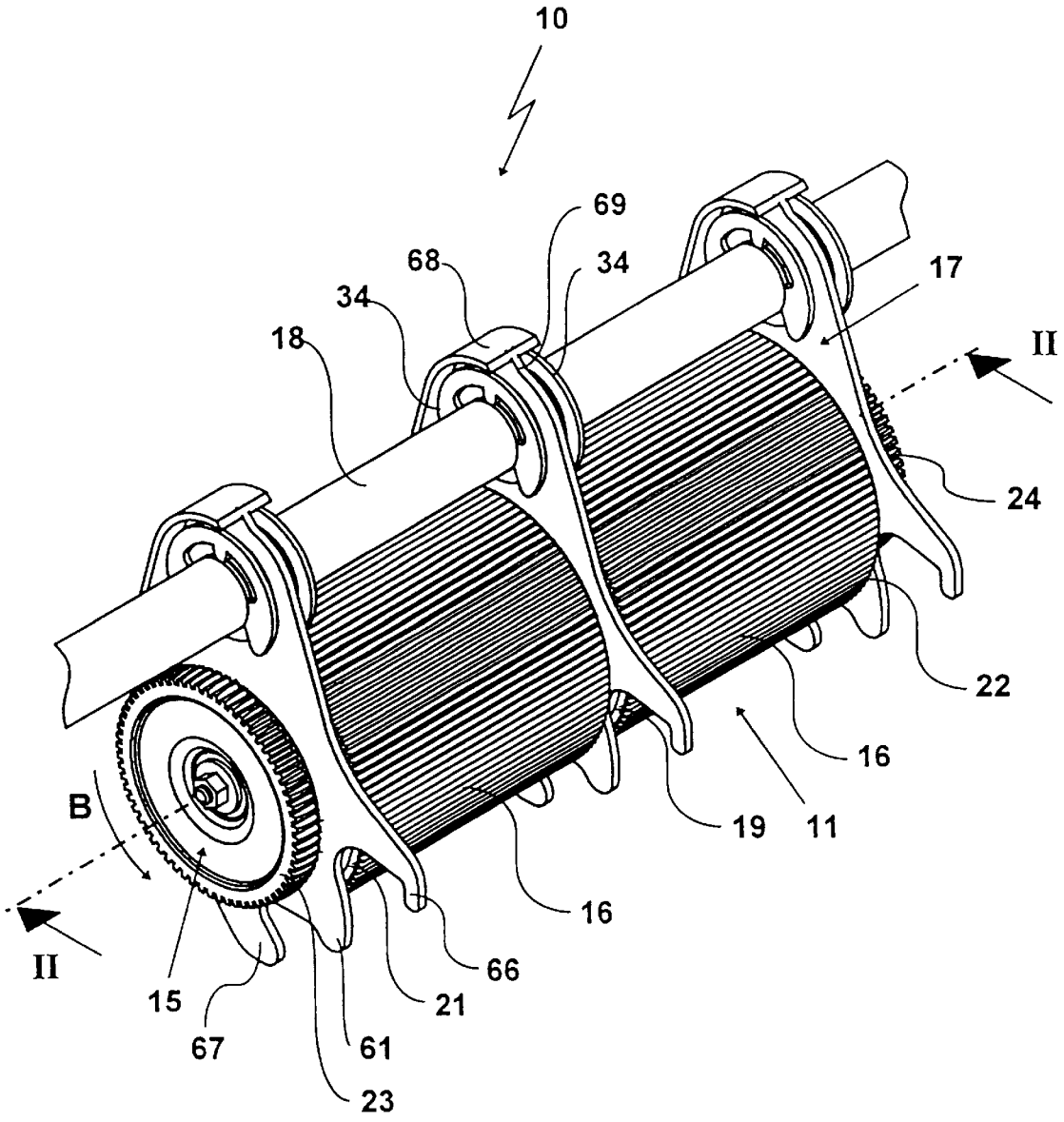
FIG. 1, which is a perspective, partially broken representation, of a fabric take-off roller arrangement for flat bed knitting machines in accordance with a preferred exemplary embodiment of the present invention, FIG. 2, which is a section along the line II—II in FIG. 1, FIG. 3, which is a section along the line III—III in FIG. 2, FIG. 4, which is a section along the line IV—IV in FIG. 3, FIG. 5, which is a representation corresponding to FIG. 1, but spread apart, of two roller elements of a fabric take-off roller, FIG. 6, which is a gear wheel of the fabric take-off roller in a perspective and enlarged representation, and FIG. 7, which is a section in accordance with a circle VII in FIG. 6 in an again enlarged representation.
Figure 3:
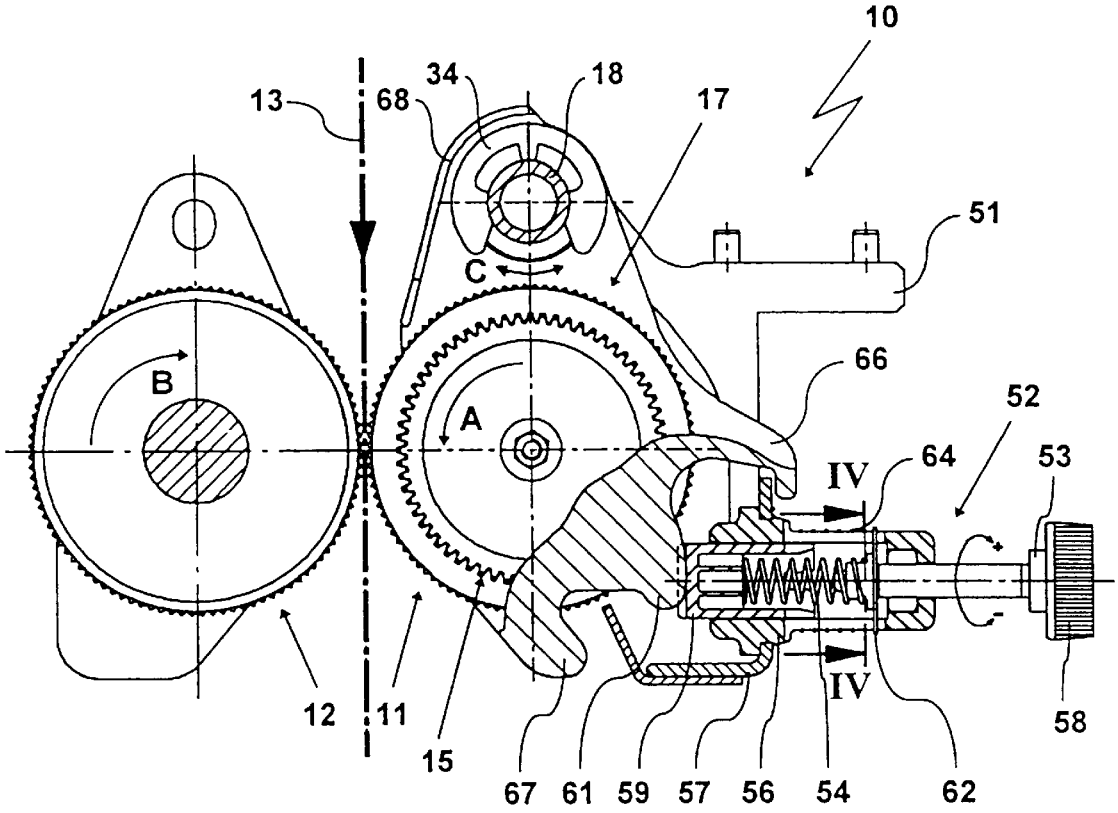
Figure 4:
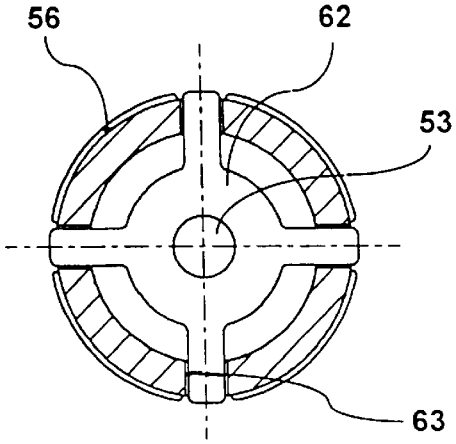

In accordance with FIGS. 1 and 3, the fabric take-off roller arrangement 10, represented here removed from the flat bed knitting machine, has a fabric take-off roller 11 and a parallel counter roller 12, whose circumferences practically touch and between which a fabric web 13 in the form of a knit fabric, only schematically represented in FIG. 3, is pulled through from the top to the bottom, or respectively taken off the flat bed knitting machine. To this end the fabric take-off roller 11 and the counter roller 12 are motor-driven in opposite directions in accordance with the arrows A and B. Such a fabric take-off roller arrangement 10 is particularly suited for so-called tie-up Jacquard machines.

As can be seen from the drawings, the fabric take-off roller 11 is put together from several identical roller elements 16 and several hinged torque transmission elements in the form of gear wheel arrangements 15. Each gear wheel arrangement 15, which is suspended by means of a bearing support 17 on a shaft, which is rigidly fastened on the flat bed knitting machine and is embodied as a tube 18, connects the ends 21 and 22 of two adjoining roller elements 16 located opposite each other in a manner fixed against relative rotation and hingedly in the direction of the possible movement of the bearing support 17.

Figure 2:
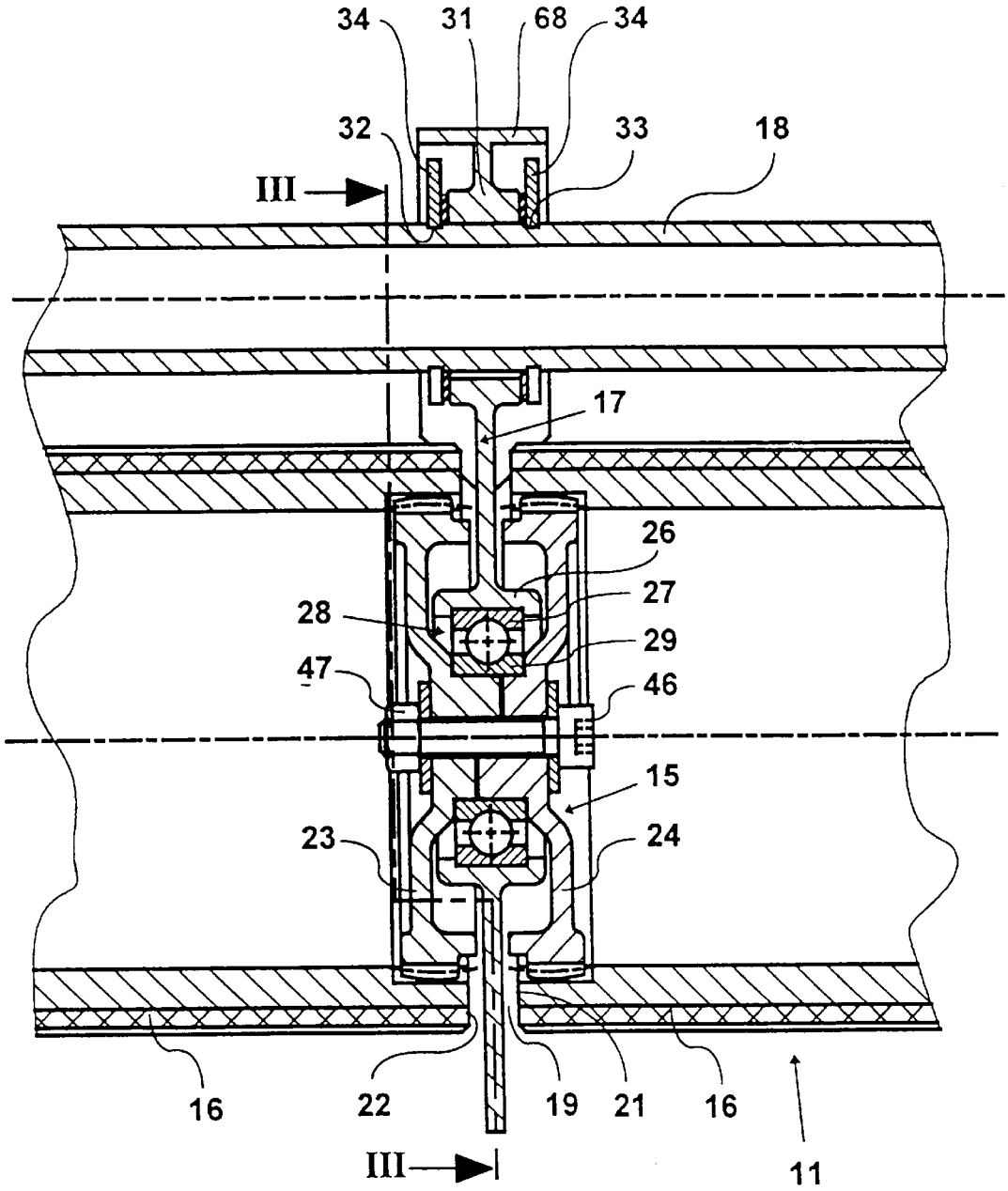
Figure 5:
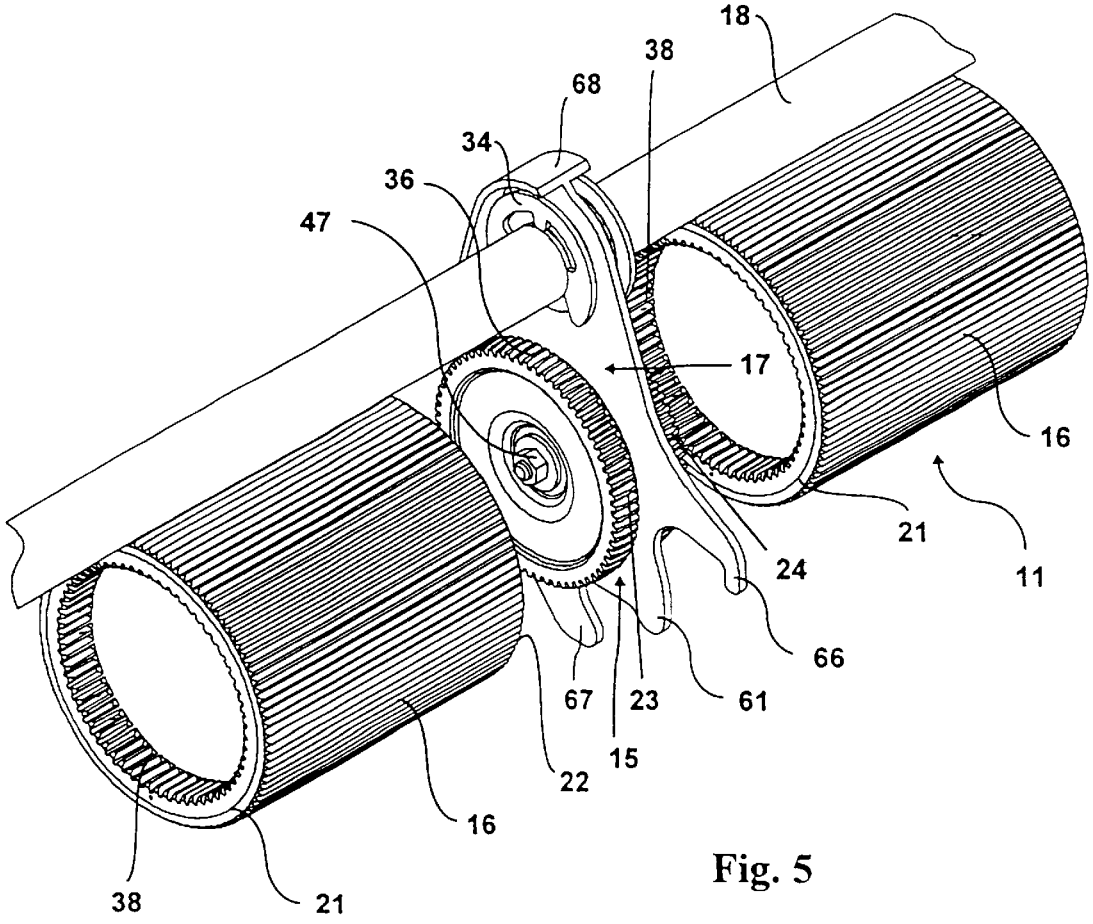

The bearing support 17, maintained pivotably in the direction of the two-headed arrow C on the tube 18, is essentially designed plate-like in accordance with FIGS. 1 and 5, and essentially extends over the entire gap area 19 of the ends 21 and 22, located opposite each other, of adjoining roller elements 16, wherein it extends out of the end of the gap area 19 facing away from the tube 18. In accordance with FIG. 2, the bearing support 17 has a circular cutout, delimited by an axially widened annular collar 26, in the area of the interior of the hollow-cylindrical roller elements 16. The outer collar 27 of a radial rolling bearing 28 is received in the inner circumference of the annular collar 26, and its inner collar 29 is held, fixed against relative rotation, between the two gear wheels 23 and 24 of the gear wheel arrangement 15. With its bearing shell 31, the bearing support 17 is maintained on the tube 18, which is provided with annular recesses 32 and 33 on both sides of the bearing shell 31, into which lock washers 34 have been inserted, so that the bearing support 17 is fixed in place in the axial direction on the tube 18. These annular recesses 32 and 33 are arranged in pairs at defined distances on the tube 18, so that the length of the bearing supports 17 is predetermined.

Figure 6:
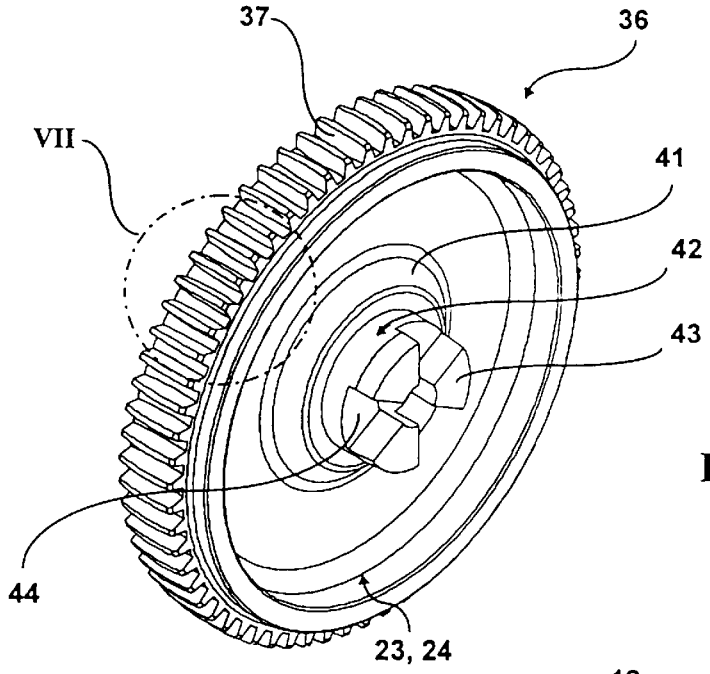
Figure 7:
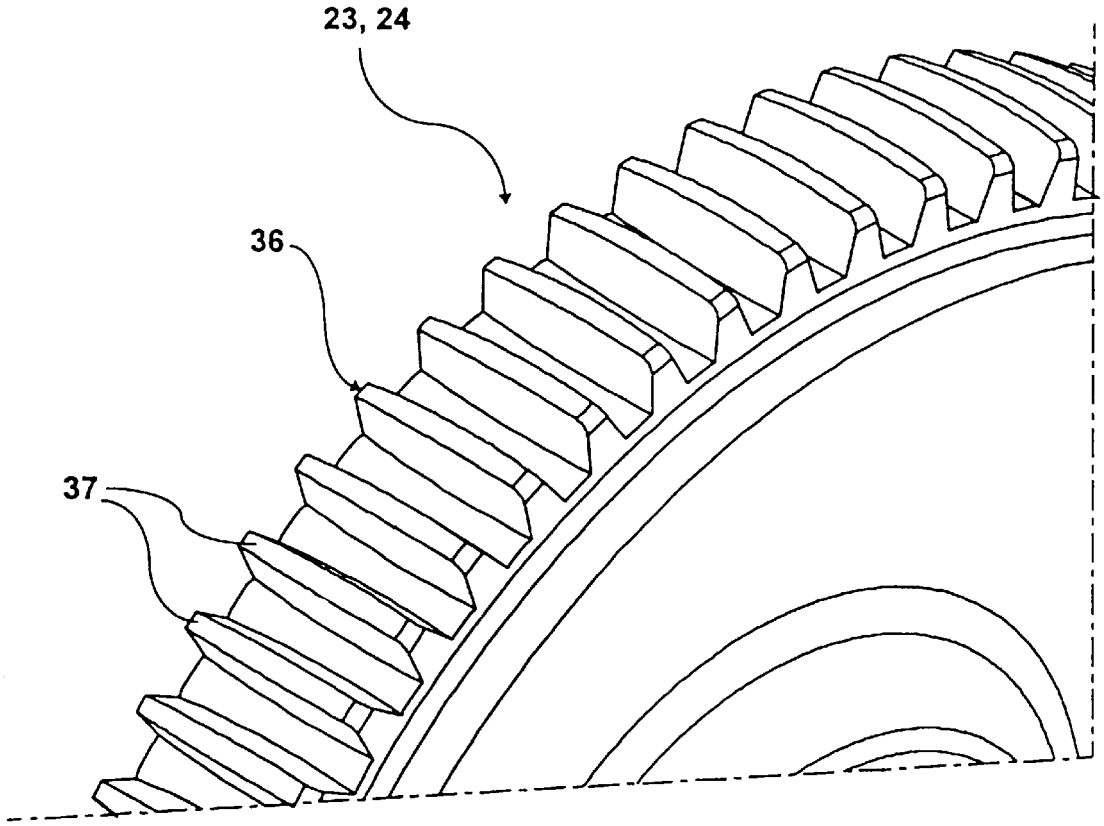

The identically designed gear wheels 23 and 24 of respectively one gear wheel arrangement 15 are provided in accordance with FIGS. 6 and 7 with an outer gear ring 36, whose teeth 37 are arcuate transversely to the circumference and crowned in longitudinal cross section. The outer gear ring 36 of each gear wheel 23, 24 meshes with an inner gear ring 38 of the respective hollow roller element 16. One end of the inner gear ring 38 of the roller element 16 provided with straight teeth is flush with the respective end 21, 22 of the roller element 16. The width of the inner gear ring 38 is slightly greater than that of the outer gear ring 36 of the gear wheel 23, or respectively 24. A hinged connection between the gear wheel arrangement 15 and the adjoining roller elements 16, or respectively of adjoining roller elements with respect to each other results from the arcuate and crowned embodiment of the teeth 37 of the outer gear ring 36 of the gear wheels 23, 24. This hinged connection is necessary during the pivot movement of the bearing support 17 in accordance with the two-headed arrow C.

In accordance with FIG. 6, the gear wheel 23, 24 has a coaxial hub 41 on one side, which has an interlocking profile 42 on the front, whose protruding profile elements 43 have the same geometry as the recessed profile elements 44. This geometry makes it possible to connect two gear wheels 23, 24 interlockingly by means of the profile 42, and therefore fixed against relative rotation by being placed one in the other, as can also be seen in FIG. 2. Two adjoining gear teeth 23 and 24 are kept together with the aid of a connection made of a screw 46 and nut 47 through the hub 41. The screw-and nut connection 46, 47 is tightened in such a way that the two gear wheels 23 and 24 are axially braced against each other and because of this clamp the inner ring 29 of the radial rolling bearing 28 between themselves in a frictional connection. Since the hubs of the gear wheels 23, 24 are bordered at the circumference by the inner ring of the rolling bearing 28, the elastic deformation of the plastic material because of the force of the springs can only act in the area of the claw connection and in this way assures that the latter is free of play.

Assembly of the fabric take-off roller 11, consisting of the roller elements 16 and the gear wheel arrangements 15, takes place as follows: first, preassembly of the gear wheel arrangement 15 of respectively two gear wheels 23 and 24 on the bearing support 17 provided with the radial rolling bearing 17 is performed. A first bearing support 17 is pushed over the tube 18 and fixed in place at the predetermined outermost position of the annular recesses 32 and 34 by means of the lock washers 34. Thereafter, a roller element 16 is pushed with one of its ends 22 on the gear wheel 23 of the first bearing support 27, so that the outer teeth come into engagement with the inner teeth 38. Thereafter, the next preassembled bearing support is pushed on the tube 18 sufficiently far, so that the gear wheel 24 facing the previous roller element 16 comes into engagement with the latter. In this position the bearing support 17 is maintained between two annular recesses 32 and 33 on the tube 18 and can be axially secured there by means of lock washers 34. Thereafter, another roller element 16 is pushed on the facing gear wheel 23 of the last inserted support roller 17, etc., until the fabric take-off roller 11 is complete. Since the teeth 37 of the outer gear rings 36 of the gear wheel arrangement 15 are rounded at the tooth flanks and the tooth body, they are only in point contact with the straight tooth flanks of the inner teeth 38 of the roller element 16, so that an interlocking connection, which is used for transmitting torque, but yet is spatially movable, between the gear wheel arrangement 15 and the roller elements 16 results. Because of this it is possible that a section of a roller element 16 can be lifted off the counter roller 12 by a thickening in the knit fabric, but still rests with its remaining active surface against the counter roller 12 in order to introduce the take-off force also into the non-thickened area.

As can be seen from FIG. 3, the rigid tube 18 is arranged exactly above the imagined longitudinal axis of the fabric take-off roller 11, and the two rollers 11 and 12 are located in one horizontal plane. A tensioning device 52 for each roller element 16 is fastened below the horizontal center plane of the two rollers 11 and 12 in the circumferential area of the fabric take-off roller 11, which faces away from the counter roller 12, on a needle bed support or machine column 51, which is used to resiliently press the fabric take-off roller 11 against the rigid counter roller 12 in the respective roller element connecting area. The housing 56 of the tensioning device 52 is fixed in place on a center rail 57, which is fixed in place on the machine column or the like. A screw spindle 53 projects into the housing 56, whose inner end, which can be moved in the axial direction by a rotating knob 58, presses via a compression spring 54 against an axially movable pressure element 59. Via the pressure element 59, the force of the compression spring 54 is brought to bear on a cam 61 of the bearing support 17, which in this way presses two adjoining roller elements 16 of the fabric take-off roller 11 against the counter roller 12. The threaded spindle is connected, fixed against displacement, in its inner area with an indicator element 62, in this case cross-shaped, which is guided with its wings, which here are arranged in a cross shape, respectively in a housing slot 63. The path of the screw spindle movement, and thus the respectively applied pressure force on the bearing support, can be read off on circumferential graduation rings 64. During further production, a pressure force specific for a knit article can be directly set by means of the graduation at a later time. Furthermore, the bearing support 17 has a projection 66 above the cam 61, which faces an area of the angled rail 57 and limits the pivot path of the bearing support 17 when the pressure force is applied to the cam 61 and the counter roller 12 is pivoted away.

On the side facing away from the projection 66, and therefore facing the counter roller 61, the bearing support 17 has a protrusion 67, which is used as a deflection surface to prevent a piece of knit fabric winding itself around the fabric take-off roller, if it should adhere to the take-off roller 11 because of an electrostatic charge. The bearing support 17 furthermore has a cover strip 68, which is relatively wide in comparison with the thickness of the bearing support 17 and which rests on the narrow circumferential edge 69 of the bearing support 17 and is maintained in place there in an area which, as can be seen from FIG. 3, extends approximately from the vertical longitudinal center plane in the direction toward the counter roller 12 to the gap 19 between two adjoining roller elements 16. The gap 19 between two adjoining roller elements 16 is covered by means of this, so that no loose knitting threads can be wound.

We claim:

1. A fabric take-off roller arrangement for a knitting machine, comprising:

at least two fabric take-off rollers arranged parallel to each other and between which a fabric web is tangentially guided, with a least one of said fabric take-off rollers including at least two roller elements arranged adjacent to each other in the axial direction of the roller;

a bearing support for each of the two adjacent roller elements, said bearing support pivotable in a direction vertically to the orientation of said roller elements, said roller elements being hingedly seated relative to each other and to said bearing support, and moreover being pressed against the other of said at least two take-off rollers in an individually adjustable manner, said roller elements also including facing ends provided with a gear ring; and a gear wheel arrangement rotatably maintained in said bearing support, said gear wheel having teeth engageable with adjacent gear rings thereby fixing said adjacent roller elements against relative rotation, said teeth being arcuate transversely with respect to the circumference of said gear wheel and crowned in the longitudinal direction of said gear wheel.

2. The fabric take-off roller arrangement as defined in claim 1, wherein said gear wheel arrangement includes two axially adjoining gear wheels of equal diameter, which receive said bearing support between them and which are connected to each other to be fixed against relative rotation.

3. The fabric take-off roller arrangement as defined in claim 2, wherein each gear wheel has said gear teeth which are arcuate and crowned identically.

4. The fabric take-off roller arrangement as defined in claim 2, wherein on the axial end of each gear wheel there is included a form closure profile fitted into each other.

5. The fabric take-off roller arrangement as defined in claim 2, wherein said two axially adjoining gear wheels are braced against each other in the axial direction.

6. The fabric take-off roller arrangement as defined in claim 2, further comprising:

a radial roller bearing arranged in said bearing support and between two adjacent roller elements, said radial roller bearing having an inner ring clamped between said two gear wheels, and an outer ring fixedly connected against relative rotation with said bearing support.

7. The fabric take-off roller arrangement as defined in claim 1, further comprising:

a rigid shaft on which said bearing supports are rigidly pivotably suspended, said rigid shaft being essentially parallel to the longitudinal extension of said take-off rollers, and wherein said rigid shaft is provided with fixation elements for said bearing supports as predetermined distances along its longitudinal extent.

8. The fabric take-off roller arrangement as defined in claim 7, wherein said fixation elements comprise recesses in said rigid shaft for receiving lock washers.

9. The fabric take-off roller arrangement as defined in claim 1, wherein said bearing supports comprise flat, plane plate-like elements which extend through the entire gap defined by adjacent roller elements.

10. The fabric take-off roller arrangement as defined in claim 9, wherein each bearing support includes a deflection protrusion which faces away from said rigid shaft and projects over said roller elements.

11. The fabric take-off roller arrangement as defined in claim 10, wherein each bearing support further includes a transversely extending cover strip on its outer edge between said radial roller bearing and the oppossing roller.

12. The fabric take-off roller arrangement as defined in claim 7, further comprising:

an adjustable tensioning unit, and wherein each bearing support includes on its end facing away from said rigid shaft and protecting over said roller elements a cam which receives the force exerted by said tensioning unit.

13. The fabric take-off roller arrangement as defined in claim 12, wherein each bearing support also includes a projection which limits its pivoting path.

14. The fabric take-off roller arrangement as defined in claim 12, wherein said tensioning unit has a graduated sleeve.

15. The fabric take-off roller arrangement as defined in claim 1, wherein the knitting machine comprises a flat bed knitting machine.

* * * * *